US006050333A

United States Patent [19]

Albaroudi

[11] Patent Number: 6,050,333

[45] **Date of Patent: *Apr. 18, 2000**

[54] ROTARY HEAT EXCHANGE APPARATUS FOR CONDENSING VAPOR

[76] Inventor: Homam M. Albaroudi, 3312 Burbank, Ann Arbor, Mich. 48105

[ * ] Notice: This patent issued on a continued prosecution application filed under 37 CFR 1.53(d), and is subject to the twenty year patent term provisions of 35 U.S.C. 154(a)(2).

[21] Appl. No.: 08/967,554

[22] Filed: Nov. 10, 1997

[51] Int. Cl.[7] ..... F28B 1/08; F28B 1/04; F28B 3/08; F28B 7/00

[52] U.S. Cl. ..... 165/281; 165/287; 165/41; 165/51; 165/86; 165/110; 165/104.32; 165/104.27

[58] Field of Search ..... 165/86, 110, 104.32, 165/281, 287, 41, 51, 104.27

[56] References Cited

U.S. PATENT DOCUMENTS

| | | | |
|---|---|---|---|
| 1,251,227 | 12/1917 | Harwell | 165/110 |
| 1,390,274 | 9/1921 | Clarke | 165/110 |
| 1,400,878 | 12/1921 | Howe | 165/110 |
| 1,455,739 | 5/1923 | Rushmore | 165/110 |
| 1,768,084 | 6/1930 | Leanhart | 165/110 |
| 2,023,456 | 12/1935 | Wentworth | 165/110 |
| 2,538,540 | 1/1951 | Thurman | 165/86 |
| 3,366,167 | 1/1968 | Dapper | 165/299 |
| 3,546,511 | 12/1970 | Shimula | 165/86 |
| 3,721,290 | 3/1973 | Butler, Jr. | 165/86 |
| 4,260,014 | 4/1981 | Fechan | 165/104.33 |
| 4,619,316 | 10/1986 | Nakayama et al. | 165/104.33 |
| 4,789,517 | 12/1988 | Webb et al. . | |
| 4,791,887 | 12/1988 | Winnington et al. | 165/86 |
| 4,799,538 | 1/1989 | Dagard et al. | 165/911 |
| 5,044,430 | 9/1991 | Aurea | 165/104.32 |
| 5,195,577 | 3/1993 | Kameda et al. | 165/104.33 |

FOREIGN PATENT DOCUMENTS

| | | | |
|---|---|---|---|
| 0162578 | 11/1985 | European Pat. Off. | 165/86 |
| 0741100 | 2/1933 | France | 165/86 |
| 0138684 | 10/1981 | Japan | 165/86 |
| 1101626 | 7/1984 | U.S.S.R. | 165/86 |

OTHER PUBLICATIONS

"Experimental Simulations of a Rotating Bubble Membrane Radiator for Space Nuclear Power Systems." by Homam M. Albaroudi publication date Mar. 30, 1993.

*Primary Examiner*—John K. Ford
*Attorney, Agent, or Firm*—Young & Basile, PC

[57] ABSTRACT

An heat exchanger apparatus mounted in a closed volume, such as a vehicle overflow tank or vehicle radiator, includes a rotating member divided internally by a stationary disk, with the interior of the rotating member and the disk connected in fluid flow communication with a refrigerant to enable the rotating member to act as a heat sink to sweep condensate back into the surrounding closed volume tank or radiator. The rotating member is rotated at a constant speed to provide a specified heat exchange capacity to enable the engine to operate for extended periods without use of the main heat exchanger or radiator.

13 Claims, 4 Drawing Sheets

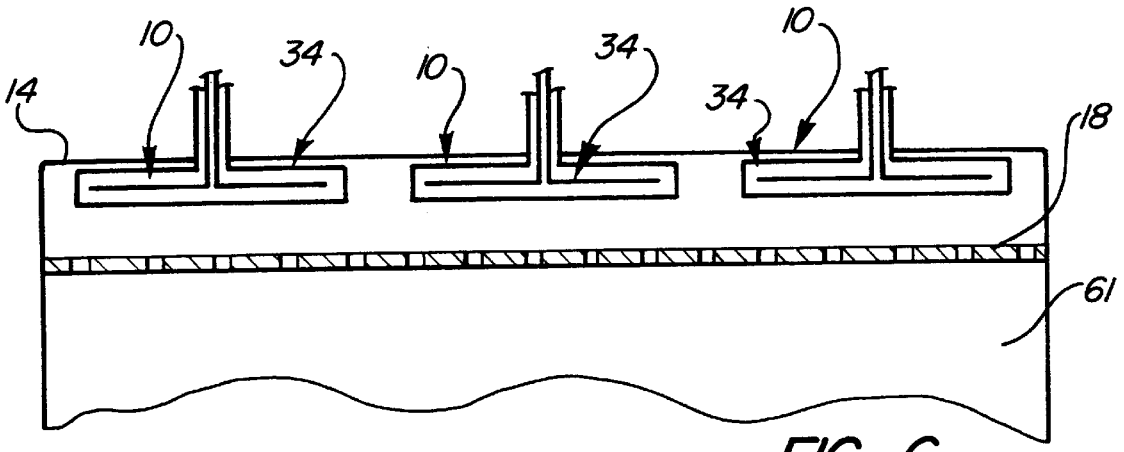
FIG-6
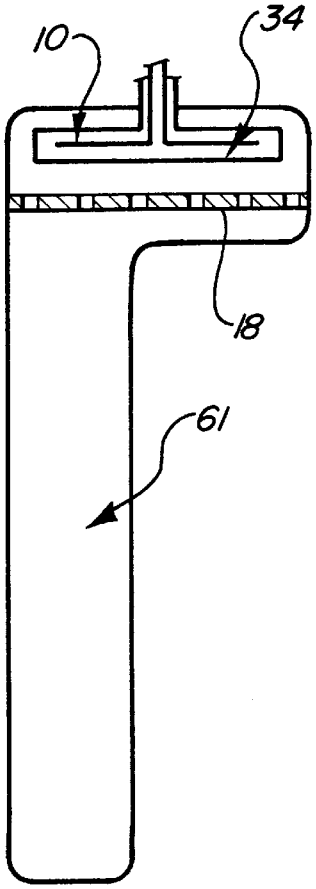
FIG-5
FIG-7
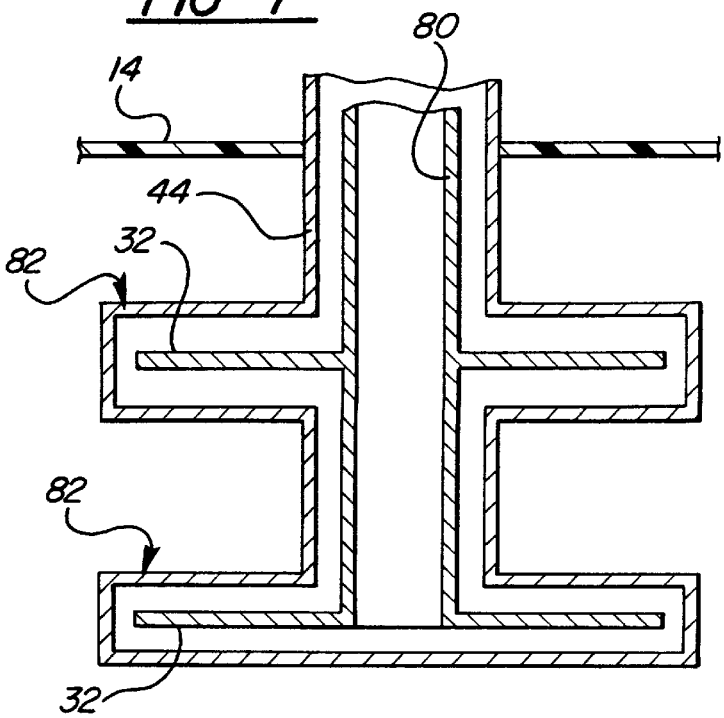

ROTARY HEAT EXCHANGE APPARATUS FOR CONDENSING VAPOR

BACKGROUND OF THE INVENTION

1. Field of the Invention

The present invention relates, in general, to radiators or heat exchangers and, more particularly, to vehicle radiators.

2. Description of the Art

Heat exchangers are used in various applications to remove waste heat from industrial processes. In the case of a vehicle, a radiator is employed to remove heat or combustion from the engine. The vehicle radiator includes a core which is connected in fluid communication with fluid passages through the engine block to circulate coolant through the block. The coolant picks up heat from the engine block and radiates the heat through radiator fins as it circulates through the radiator. An engine driven fan is provided along one side of the radiator to provide a cooling air flow onto the fins to increase the heat exchange rate, particularly when the vehicle is not in motion or is operating at low speed insufficient to generate a high speed air flow onto the radiator.

While vehicle radiators with engine driven fans have been effectively used for many years in millions of vehicles, a problem always exists when a radiator loses efficiency, coolant or the fan belt breaks. If not immediately detected, the loss of cooling capacity can result in serious if not fatal damage to the engine. Even if detected, a loss of cooling efficiency results in overheating of the engine coolant thereby requiring the engine to be shut off and the vehicle rendered immobile for an extended period of time until the coolant temperature decreases.

Thus, it would be desirable to provide an auxiliary or emergency heat exchange apparatus which removes waste heat from a two phase fluid circulating in a heat generating apparatus to provide adequate cooling upon deactivation of the main heat exchanger or radiator. It would also be desirable to provide such a heat exchange apparatus which can be easily mounted in an existing cooling system, such as a vehicle cooling system, without requiring major modification to the cooling system. It would also be desirable to provide an auxiliary or back-up heat exchange apparatus which utilizes condensation phenomenon.

It is known in the film-wise condensation of vapor that latent heat of condensation passes through a film of liquid on its way to the condensation surface. The predominant mode of heat transfer through the film is conduction. Since most liquids have a low thermal conductivity, the condensate film provides a substantial resistance to heat transfer. If the condensate film is not removed from the condensing surface, it thickens and increases the resistance to heat transfer. In most stand alone industrial condensers, the condensate continually drains away from the cooling surface by gravity.

It is well recognized that centrifugal forces generated in a rotating system may be utilized to replace the gravity force in the condensation process. Condensation may be film-wise when there is a continuous flow of liquid over the cooling surface, or drop-wise when the vapor condenses in droplets and the cooling surface is not completely covered by liquid.

After a condensate film is developed in film-wise condensation, additional condensation will occur at the liquid-vapor interface, and the associated energy transfer must occur by conduction through the condensate film. Drop-wise condensation, on the other hand, always has some surface present as the condensate drop forms and runs off. Drop-wise condensation is, therefore, associated with a higher heat transfer rates of the two types of condensation phenomenon.

Specifically, because of the mechanism of drop-wise condensation, heat transfer coefficients can be about four to twenty times those of film-wise condensation. Additives to promote drop-wise condensation by preventing the condensate from wetting the surface have been used with varying degrees of success, and are effective only for limited periods of time.

Drop-wise condensation is attractive for applications where extremely large heat transfer rates are desired. However, because of its uncertain nature and the conservative approach needed in the design of heat transfer systems, film-wise condensation heat transfer coefficients are predominantly used.

SUMMARY OF THE INVENTION

The present invention is a heat exchange apparatus which provide auxiliary or emergency heat exchange capability in the event of main heat exchanger failure or loss of heat exchanger cooling efficiency.

In a first embodiment, the heat exchange apparatus of the present invention is employed to remove waste heat from a two phase fluid in a circulating heat generating apparatus. The heat exchange apparatus comprises a closed volume receiving a heated two phase liquid, the two phase liquid circulating through the closed volume and absorbing heat from a heat generating source. A rotating member is disposed in the closed volume and has a hollow interior. A refrigerant fluid circulates through the interior of the rotating member enabling the rotating member to act as a heat sink to condense vapors of the two phase fluid to condensate whereby the rotating member sweeps the condensate by centrifugal force into the closed volume.

A stationary disk is mounted within the interior chamber of the rotating member. A first conduit is connected to the disk and opens through the disk into the interior chamber. The first conduit is connected to a refrigerant source. A second conduit is connected to the rotating member and the refrigerant source. The first and second conduits form a closed path from the refrigerant source about the disk and through the interior chamber of the rotating member.

The first conduit is preferably disposed concentrically within the second conduit.

Means are provided for rotating the rotating member at a constant speed. Baffle means having a plurality of spaced apertures is mounted in the closed volume below the rotating member.

Means, responsive to one of a predetermined temperature and a predetermined pressure in the closed volume activate the rotating means when one of the predetermined temperature and predetermined pressure is reached.

In a specific application, the closed volume is a vehicle radiator overflow tank. The closed volume can also be the main vehicle radiator. A plurality of rotating members may be disposed within the closed volume. The disk and the rotating member can have any suitable configuration, such as planar or conical.

An auxiliary or emergency heat exchanger is disposed for use in a vehicle having a radiator with a two phase coolant disposed in fluid flow communication with a vehicle engine for removing waste heat from the vehicle engine. The heat exchanger comprises a closed volume receiving the heated two phase coolant. The two phase coolant circulates through the closed volume and the engine and absorbs heat from the heat engine. A rotating member is disposed in the closed volume and has a hollow interior. A refrigerant fluid circulates through the interior of the rotating member enabling the rotating member to act as a heat sink to condense vapors of the two phase fluid to condensate whereby the rotating member sweeps the condensate by centrifugal force into the closed volume.

The heat exchange apparatus of the present invention provides auxiliary cooling capacity in a heat generating system, such as a radiator found in a vehicle, to provide adequate back up or emergency cooling capacity in the event of main radiator failure. The heat exchange apparatus of the present invention can be added to an existing heat exchanger system, such a vehicle cooling system, without requiring significant modification to said cooling system. Further, the auxiliary heat exchanger of present invention can be provided in different sizes as well as rotatable at different speeds to provide any desired cooling capacity.

BRIEF DESCRIPTION OF THE DRAWING

The various features, advantages and other uses of the present invention will become more apparent by referring to the following detailed description and drawing in which:

FIG. 5 is a partially cross-sectioned, side elevational view of the alternate embodiment shown in FIG. 4;

FIG. 6 is a pictorial view of yet another embodiment of the heat exchange apparatus of the present invention;

FIG. 7 is a cross-sectional view showing an alternate embodiment of the auxiliary heat exchanger of the present invention.

DESCRIPTION OF THE PREFERRED EMBODIMENTS

Figure 1:
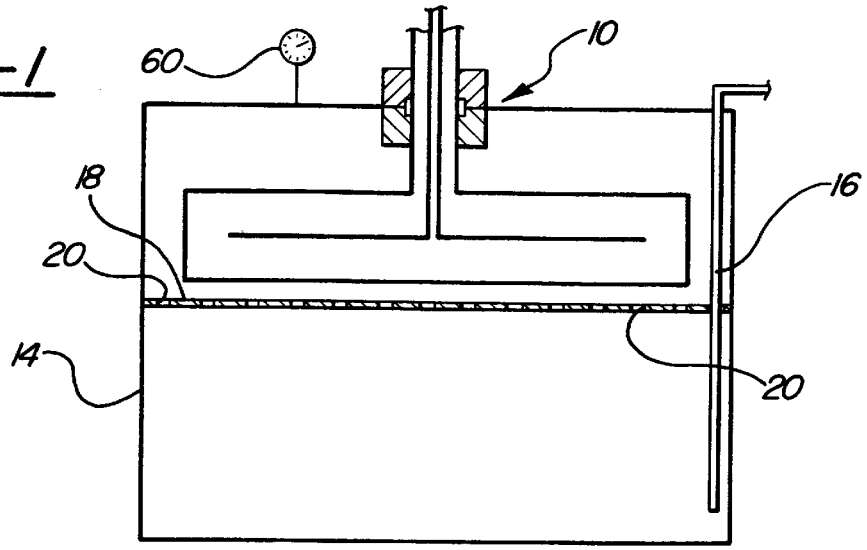
FIG. 1 is a pictorial representation view of a vehicle radiator overfill reservoir tank with one embodiment of a heat exchange apparatus of the present invention mounted therein.
Figure 2:
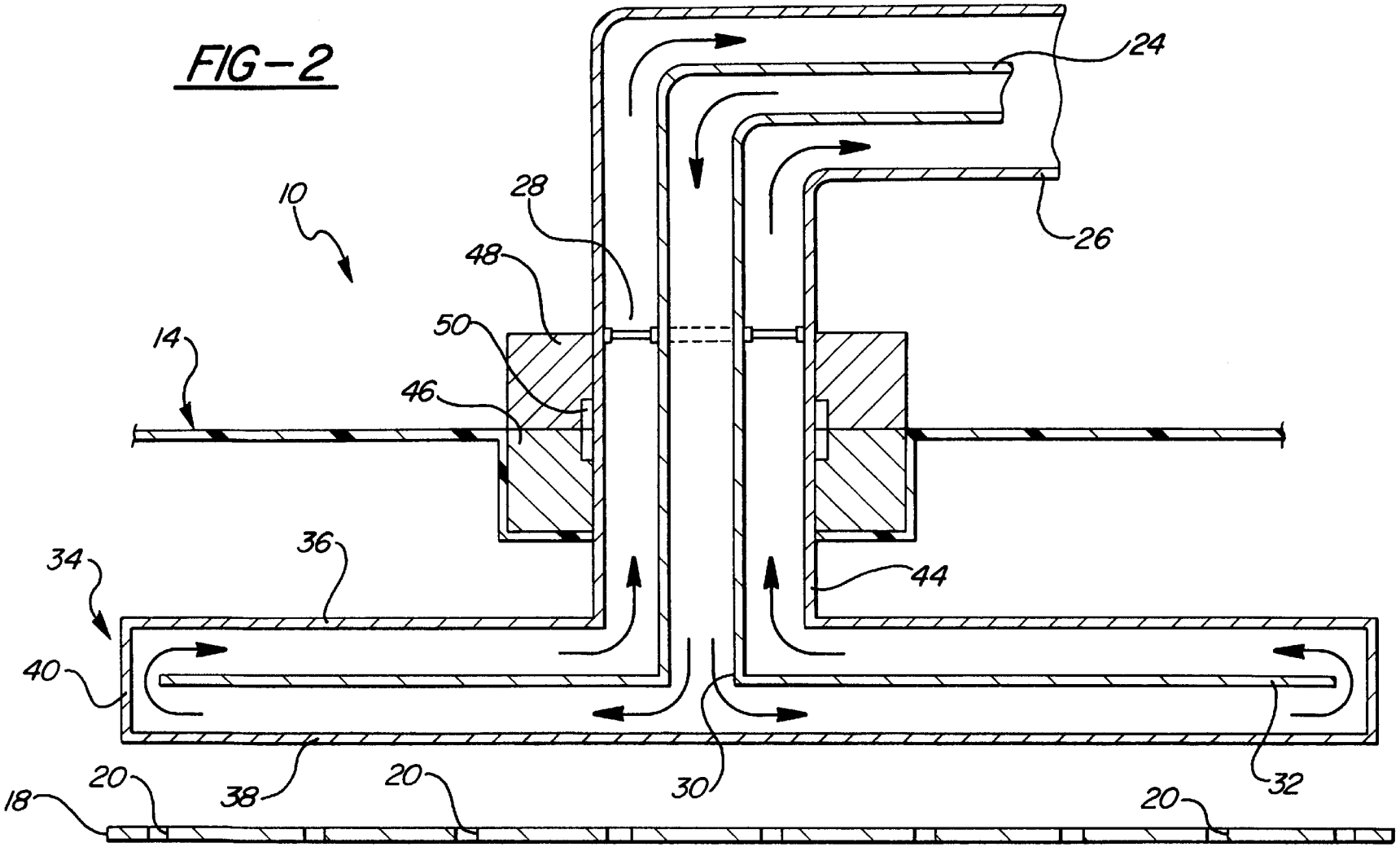
FIG. 2 is an enlarged cross-sectional view of the top portion of the overfill reservoir tank shown in FIG. 1.

Refer now to the drawings, and to FIGS. 1 and 2 in particular, there is depicted first embodiment of a heat exchange apparatus 10 particularly suited for use in a vehicle, such as an automobile, truck, etc.

Although the heat exchange apparatus 10 is described in conjunction with a vehicle radiator or cooling system, it will be understood that the present heat exchange apparatus can be employed in other applications which require cooling, such as aviation, heavy equipment, tools or space applications.

In this embodiment, the heat exchange apparatus 10 is mounted in a conventional overfill reservoir tank 14 which is connected in fluid flow communication via a conduit 16 with an existing vehicle engine radiator, not shown. As is well known, the overfill/reservoir tank 14 stores additional quantities of engine coolant i.e., water, antifreeze or mixtures thereof, and provides an expansion space when the coolant reaches an elevated temperature.

A spacer or baffle plate 18 is mounted in the tank 14 generally above the level of liquid normally present in the bottom of the tank 14. A plurality of apertures 20 are formed in the plate 18 to allow vapors from the bottom of the tank 14 upward to the top of the tank 14 and the reverse flow of liquid condensate back into the bottom of the tank 14. In normal operation, the plate 18 prevents, to some extent, splashing of the fluid from the bottom of the tank to the heat exchanger or, when the fluid overheats, it prevents the fluid from reaching the heat exchanger.

The heat exchange apparatus 10 includes a unique rotating assembly which condensation phenomenon to cool overheated coolant or vapors when in operation. First and second conduits 24 and 26 are connected at one end to a source of refrigerant such as the Freon or equivalent typically employed in a vehicle air conditioner, not shown. In a preferred embodiment, the first conduit 24 is concentrically disposed centrally within the second or outer conduit 26. At least one spacer 28 is interposed between the first and second conduits 24 and 26. The spacer 28 is in the form of two annular disks, one sized to fit closely about the outer diameter of the first conduit 24 and the second or outer disk sized to fit snugly against the inner diameter of the outer conduit 26. A plurality of ribs extend radially between the inner and outer disks to form the rigid spacer separating the first and second conduits 24 and 26.

The first and second conduits 24 and 26 may be rigid metal, high strength plastic conduits, or flexible hoses. Further, due to the need to carry low temperature refrigerant, the first and second conduits 24 and 26 are preferably formed of a insulating material or wrapped with an insulated outer layer.

The first conduit 24 projects through the top wall of the overfill tank 14 as shown in FIGS. 1 and 2 to an outlet 30. A divider 32 in the form of a single annular disk or plate is connected to and extends radially outward from the outlet 30 at one end of the first conduit 30. The annular disk or divider 32 is formed of a low thermal conductivity material, such as plastic.

A rotating assembly or member 34 is rotatably mounted in the top wall of the overfill tank 14 surrounding the divider 32 and is disposed in fluid flow communication with the second conduit 26. The rotating assembly 34 is formed of first and second spaced generally planar plates 36 and 38 which are sealingly joined at their outer peripheral ends to an annular wall 40 thereby forming a hollow enclosure with an interior chamber 42. The plates 36 and 38 are preferably formed of a high thermal conductivity material, such as stainless steel, aluminum, etc. Other lighter weight materials including fiber and metallic alloys, carbon epoxy materials, silica based materials, silicon carbide cloths with metallic liners, and niobium-tungsten composites may also be employed. A short conduit 44 extends centrally from the first plate 36 and is disposed in fluid communication with the second conduit 26 and the interior chamber 42.

The magnetic member or rotor 46 is fixedly connected to an upper end of the conduit 44. The magnetic member 46 preferably forms the rotor of a motor 46 interacts with an adjacent stator 48 of the motor. The magnetic member 46 is rotatably supported in the upper portion of the top wall of the tank 14 as shown in FIG. 2. Seal elements 50, such as O-rings, may be mounted in grooves in the stator 48 to sealingly couple the stator 48 with the outer surface of the conduit 44 and/or second conduit 26. In this manner, the interior of the conduit 44 and the interior chamber 42 in the rotating assembly 34 are disposed in fluid communication with the first conduit 24 and the second conduit 26 thereby providing refrigerant flow from the first conduit 24 in the direction of the arrows in FIG. 2 around the bottom surface of the divider 32, over the opposed surface of the divider 42, and out through the conduit 44 and the second outer conduit 26. This forms the interior chamber 42 of the rotating assembly 34 as a heat sink to remove heat from vapors in the upper portion of the tank 14 resulting from overheating of the coolant fluid in the bottom portion of the tank 14.

The stator 48 is mounted in a suitable motor, not shown, and connected to a source of A.C. or D.C. electrical power to rotate at a set, constant speed thereby rotating the rotor 46 and the attached rotating assembly 34 to provide condensation and a radially outward expelling of condensate by centrifugal force from the first and second plates 36 and 38.

It will be understood that the above-described motor is but one example of a rotating means which can be used to rotate the member 34. Other rotating means, such as motor-gear pairs, or an electromagnetic force generator can also be effectively employed.

A pressure and/or temperature gauge 60, shown in FIG. 1, is mounted on the tank 14 in fluid communication with the interior of the tank 14. The gauge 60 generates an output signal when a predetermined pressure or temperature or combination of pressure and temperature is detected within the interior of the tank 14. This output signal is supplied to the motor resulting in the application of electric power to the stator 48 and thereby rotation of the rotor 46 at a constant speed. Other speeds may be appropriate for different heat exchange rates or cooling requirements of different sized vehicle engines. The desired amount of cooling efficiency and rotation speed engines can be determined by:

$$\frac{U\left(\frac{v}{\omega}\right)^{\frac{1}{2}}}{K} = 0.904 \left(\frac{Pr}{\frac{Cp\Delta Tov}{h_{fg}}}\right)^{\frac{1}{4}}, \text{ where}$$

U=Overall heat transfer coefficient (heat flux÷disk area)
v=Kinematics viscosity of condensate, $m^{2/°C.}$
ω=Angular velocity, meter/sec.
$P_r$=Prandtl number
$C_p$=Specific heat of condensate, J/Kg.°C.
$\Delta T_{ov}$=Overall temperature difference, °C.
$h_{fg}$=Latent heat of condensate, J/Kg Since all the variables are known and a predetermined disk or plate area 36 and 38 is selected by a designer, with the total amount of heat to be rejected determined by the amount of heat supplied by the main radiator fan, the rotational or angular velocity of the rotating assembly 34 can be determined and generated by the motor by supplying a suitable current to the stator 48 in accordance with conventional motor design practice.

Figure 8A:
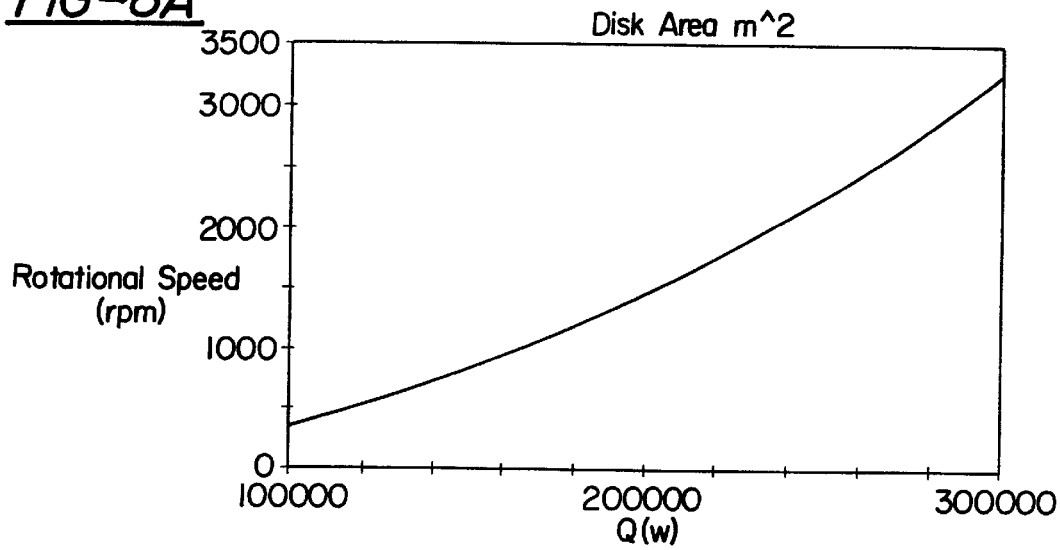
FIGS. 8A–8C are graphs depicting the relationship between rejected heat and speed of rotation of the rotating disks of the heat exchange apparatus of the present for various disk areas.
Figure 8B:
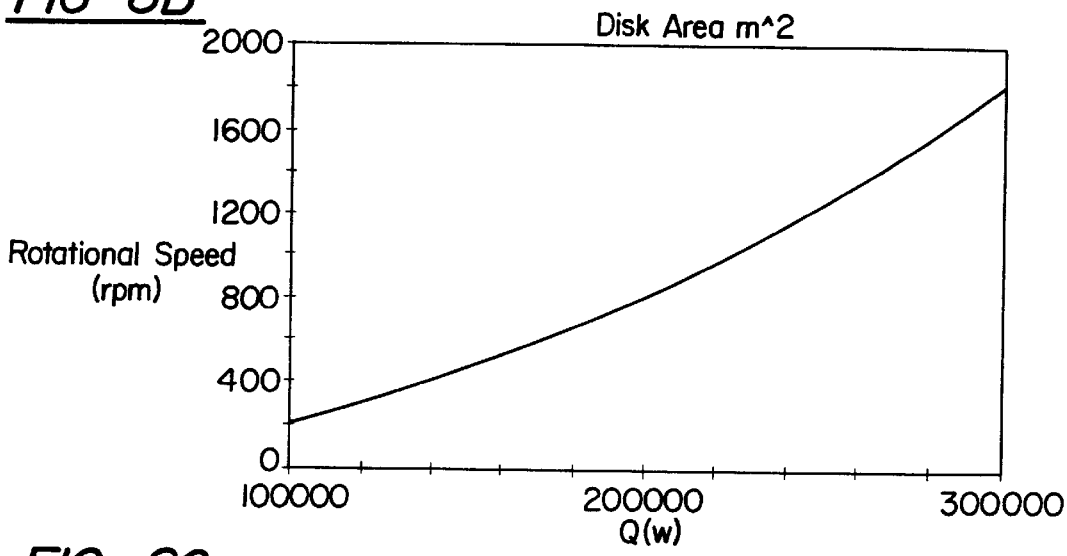
Figure 8C:
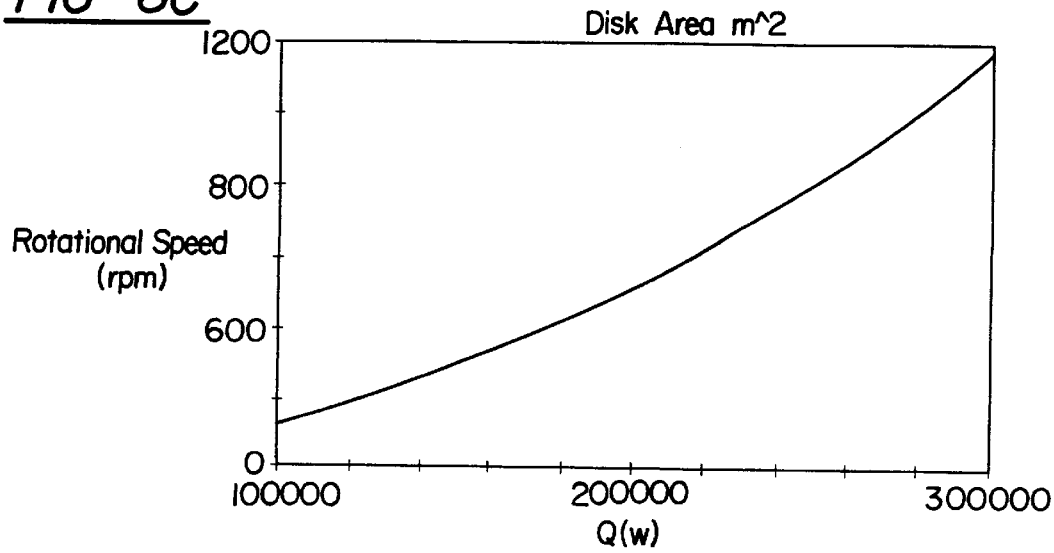

FIGS. 8A, 8B and 8C depict graphs showing the relationship between the amount of heat q(w) to be rejected by the heat exchanger 10 and the corresponding speed of rotation of the rotating disk in revolutions/minute of the plates 36 and 38, etc., for various disk or rotating plate surface areas. The graphs depicted in FIGS. 8A–8C result from solution of the above-described equation where ΔT (temperature difference between operating temperature and refrigerant temperature) is approximately 100° C., and all physical properties of the condensate are taken at 20° C. which is the expected average condensate temperature.

As can be seen in each curve depicted in the graphs of FIGS. 8A–8C, as the area of the condensing surface (i.e., the surface area of the rotating plates 36 and 38) increases, the required rotational speed of the rotating assembly 34 to reject a given amount of heat decreases. This enables the size of the rotating members or disks 36 and 38 as well as the rotational speed of the rotating assembly 34 to be selected to meet any required heat rejection quantity thereby enabling the heat exchanger 10 of the present invention to be easily devised for use in most vehicle radiator systems.

It is further desirable that the overfill tank 14 be at a vacuum to reduce the effects of non-condensible gases on the heat exchange process. This can be achieved by filling the tank 14 with water and then draining it from the bottom or by using mechanical means, such as a manual valve.

In operation, when the conventional vehicle radiator fails, the temperature and/or pressure in the overfill tank 14 will increase. When a preset temperature or pressure or combination of temperature and pressure is detected by the gauge 60, an output signal will be generated by the gauge 60 and supplied to the motor to cause rotation of the rotor 46 at a constant speed. This same signal will be used to shutdown the vehicle air conditioning system and direct the air conditioning system refrigerant to the first conduit 24 wherein the refrigerant by suitable valves will flow through the first conduit 24, the interior of the rotating assembly 34, out through the second conduit 26 and back to the air conditioning system. This cools the first and second plates 36 and 38 of the rotating assembly 34 and enables vapors to be efficiently condensed on the outer side of the rotating plates 36 and 38. Condensate will sweep due to centrifugal forces, back into the tank 14 where it can flow into the vehicle radiator and engine to cool the vehicle engine.

Figure 3:
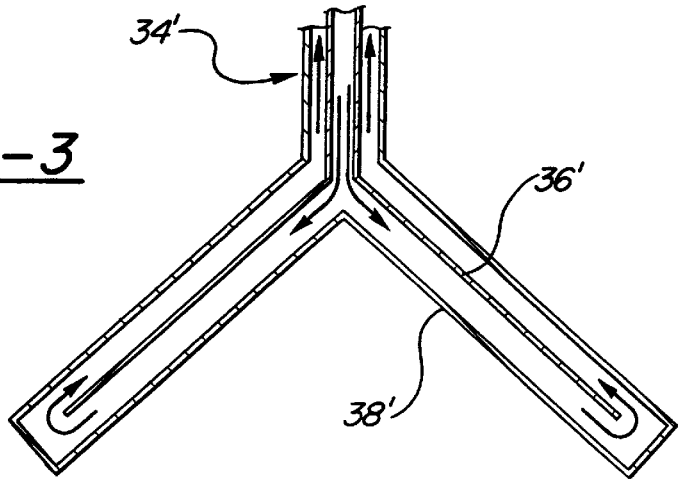
FIG. 3 is a side elevational view of alternate embodiment of the heat exchange apparatus of the present invention.

FIG. 3 depicts an alternate embodiment of the rotating assembly 34 which operates similar to the rotating assembly 34; but has first and second plates 36' and 38' disposed at a depending angle from the end of the conduit 44. This forms the housing 34' with a generally conical shape to fit different closed volume configurations. For high RPM the gravity force is negligible.

Figure 4:
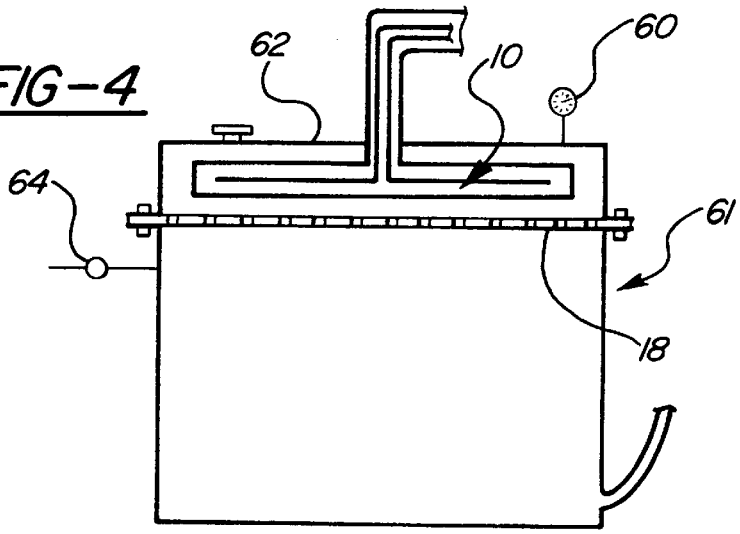
FIG. 4 is a pictorial representation of an alternate embodiment of the heat exchange apparatus of the present invention.

FIGS. 4 and 5 depict the use of the heat exchange apparatus 10 of the present invention in a modified vehicle radiator 61. The heat exchanger 10 is identically constructed to that described above and shown in FIGS. 1 and 2 and is rotatably mounted through the upper surface 62 of the radiator 61. Likewise, the gauge 60 is mounted through the upper wall 62 of the radiator 61. The baffle plate 18 is likewise mounted immediately below the heat exchange apparatus 10 and above the normal high level of the coolant in the radiator 60. A bulb valve 64 can be mounted on the radiator 61 to drain water or coolant from the radiator 61 to create a vacuum within the radiator 61 as described above to eliminate non-condensible gases from the interior of the radiator 61.

As shown in FIG. 5, the only modification necessary to the radiator 61 is a slight enlargement of the upper portion of the radiator 61 to accommodate the diameter of the rotating assembly 34 of the heat exchanger 10. This can be accomplished by a suitable top cap fixedly connected to an existing radiator housing as shown in FIG. 4.

In all of the embodiments of the present invention shown in FIGS. 1–5, the heat exchanger 10 utilizes a single rotating assembly 34 or 34'. FIG. 6 depicts a conventional vehicle radiator 61 with a plurality of identical heat exchanger 10 mounted therein. The first and second conduits 24 and 26 are connected to each of the heat exchanger 10 in parallel with the refrigerant source.

The use of a plurality of rotating assemblies 34 enables the rotational speed of each of the rotating assemblies 34 to be lowered as the total surface area of the plurality of rotating assemblies 34 increases due to the use of multiple rotating assemblies. It will also be understood that although the rotating assemblies 34 are substantially identically constructed, the plurality of rotating assemblies shown in FIG. 6 need not be of identical surface area. This enables the number and size of the rotating assemblies 34 to be varied, if necessary, to fit within the interior space of a particular overflow tank 14 or radiator 61.

FIG. 7 depicts yet another embodiment of the heat exchange apparatus 10 of the present invention in which the stationary first conduit 80 is elongated and supports at least two or stationary annular disks 32 which project radially outward at spaced locations along the length of the first conduit 80. Each stationary annular disk or plate 32 is surrounded by a rotating assembly 82, with each rotating assembly 82 integrally connected to each other to provide a single fluid flow path to the interior of the innerconnected rotating assemblies 82 from the end of the stationary first conduit 80 to the outlet of the stationary conduit 44 and the second conduit, not shown, joined thereto. This arrangement increases the total surface area of the condensation surface formed by the rotating assemblies 82 and enables the rotating speed of the multiple rotating assemblies 82 to be accordingly decreased in the manner depicted by the curves in FIGS. 8A–8C.

In summary, there has been disclosed a unique heat exchange apparatus which provides emergency cooling exchange capability in the event of failure or loss of efficiency of a main heat exchanger. The heat exchange apparatus of the present invention is simply constructed and utilizes condensation phenomenon for effective sweeping of condensate back into the closed volume, i.e., overfill tank or radiator. The heat exchange apparatus may also be easily added to existing overfill tanks or radiators without requiring significant modification to such tanks or radiators.

What is claimed is:

1. An auxiliary heat exchange apparatus for removing waste heat from a two phase fluid circulating in a movable heat generating apparatus having a primary heat exchanger, the auxiliary heat exchange apparatus comprising:

a closed volume receiving heated two phase fluid and having a liquid containing portion disposed in fluid flow communication with a vapor receiving portion;

a rotating member disposed in the vapor receiving portion of the closed volume, the rotating member having a hollow interior and rotating about a substantially vertically extending axis;

a stationary disk mounted within the interior of the rotating member;

a first conduit connected to the disk and opening at one end through the disk.

a second conduit connected to the rotating member;

the first and second conduits forming a closed path for a coolant circulating about the disk through the interior of the rotating member enabling the rotating member to act as a heat sink to condense vapors of the two phase fluid to condensate on outer surfaces of the rotating member, whereby the rotating member sweeps the condensate through centrifugal force from the outer surfaces of the rotating member for flow into the liquid containing portion of the closed volume; and a baffle having a plurality of spaced apertures mounted in the closed volume below the rotating member between the liquid containing portion and the vapor receiving portion of the closed volume.

2. The heat exchange apparatus of claim 1 wherein the first conduit is disposed within the second conduit.

3. The heat exchange apparatus of claim 1 further comprising:

means for rotating the rotating member.

4. The heat exchange apparatus of claim 3 further comprising:

means, responsive to one of a predetermined temperature and predetermined pressure in the closed volume, for activating the rotating means when one of the predetermined temperature and predetermined pressure is reached.

5. The heat exchange apparatus of claim 1 wherein the closed volume is a vehicle radiator overflow tank.

6. The heat exchange apparatus of claim 1 wherein the closed volume is a vehicle radiator.

7. The heat exchange apparatus of claim 1 further comprising:

a plurality of rotating members disposed within the closed volume.

8. The heat exchange apparatus of claim 7 wherein:

the plurality of rotating members are arranged for parallel refrigerant flow therethrough.

9. The heat exchange apparatus of claim 7 wherein:

the plurality of rotating members are innerconnected in series to form a single refrigerant flow path through the interior of the innerconnected plurality of rotating members.

10. The heat exchange apparatus of claim 9 further comprising:

each of the rotating members is hollow;

a stationary disk mounted within a interior chamber of each rotating member;

a first conduit connected to the stationary disk in all of the rotating members and opening at one end through one stationary disk, the first conduit carrying refrigerant fluid;

a second conduit connected to the plurality of rotating members and carrying the refrigerant fluid; and wherein the first and second conduits form a closed path for the refrigerant fluid about the stationary disks in the interior of each of the plurality of rotating members.

11. The heat exchange apparatus of claim 1 wherein the rotating member comprises:

first and second spaced plates joined at outer ends by an annular end wall to define a hollow interior between the annular end wall and the pair of plates.

12. The heat exchange apparatus of claim 1 wherein the rotating member has a planar configuration.

13. The heat exchange apparatus of claim 1 wherein:

the rotating member has a central stem and at least one lower leg depending at an oblique angle from the stem.

* * * * *